US009089245B1

(12) United States Patent
Pamphilis

(10) Patent No.: US 9,089,245 B1
(45) Date of Patent: Jul. 28, 2015

(54) REPLACEMENT ROD KIT

(76) Inventor: Alexander E. Pamphilis, Bethlehem, PA (US)

( * ) Notice: Subject to any disclaimer, the term of this patent is extended or adjusted under 35 U.S.C. 154(b) by 502 days.

(21) Appl. No.: 13/021,289

(22) Filed: Feb. 4, 2011

Related U.S. Application Data

(60) Provisional application No. 61/308,834, filed on Feb. 26, 2010.

(51) Int. Cl.
*A47K 10/10* (2006.01)
*A47K 10/04* (2006.01)

(52) U.S. Cl.
CPC ..... *A47K 10/10* (2013.01); *A47K 10/04* (2013.01)

(58) Field of Classification Search
CPC ..... A47K 10/04; A47K 10/08; A47K 10/10; A47H 1/02; A47H 1/022; A47H 1/142
USPC ..... 211/6, 7, 16, 88.04, 105.1, 105.3, 211/105.4, 105.5, 105.6, 105.2, 123, 204; 248/200.1, 251, 252, 254, 257, 261, 248/262, 264, 265, 266, 267, 268, 269, 271, 248/272, 273; 4/576.1, 577.1, 611
See application file for complete search history.

(56) References Cited

U.S. PATENT DOCUMENTS 549,768 A * 11/1895 Day ..... 211/105.3
645,543 A * 3/1900 Birch ..... 211/105.6
974,398 A * 11/1910 Lathrop ..... 211/105.3
1,019,232 A * 3/1912 Edsall ..... 248/262
1,050,437 A * 1/1913 Edsall ..... 248/262
1,077,083 A * 10/1913 Kroder ..... 248/262
1,279,543 A * 9/1918 Hills ..... 248/262
1,280,244 A * 10/1918 Kroedel ..... 211/123
1,548,053 A * 8/1925 Mead ..... 403/53
1,639,551 A * 8/1927 Booth ..... 211/105.6
1,837,340 A * 12/1931 Schwartz ..... 211/105.4
1,951,660 A * 3/1934 Klaudt ..... 211/123
2,215,331 A * 9/1940 Marsh ..... 248/251
2,492,517 A * 12/1949 Bernick ..... 211/123
2,577,860 A * 12/1951 Schoor ..... 211/105.1
2,647,644 A * 8/1953 Cieslik ..... 211/105.6
2,715,468 A 8/1955 Waltz
2,903,141 A * 9/1959 Seewack ..... 211/105.4
2,974,806 A * 3/1961 Seewack ..... 211/123
3,040,902 A * 6/1962 Dunn ..... 211/105.4
3,738,498 A 6/1973 Handley
3,951,269 A * 4/1976 Anderson ..... 211/105.4
4,378,071 A * 3/1983 Yakimicki ..... 211/105.4
4,498,654 A 2/1985 Cooper
4,700,918 A * 10/1987 Andrasko, Jr. ..... 248/251
4,824,302 A * 4/1989 Schultheis et al. ..... 410/151
4,895,471 A * 1/1990 Geltz et al. ..... 403/104
5,127,459 A * 7/1992 Markowitz ..... 160/263
5,564,577 A * 10/1996 Knaggs ..... 211/86.01

(Continued)

*Primary Examiner* — Stanton L Krycinski
(74) *Attorney, Agent, or Firm* — Robert C. Montgomery; Montgomery Patent & Design, LP.

(57) ABSTRACT

A replacement rod device for replacing a broken towel rack rod includes a main rod, a spacer rod, and pair of sleeves. The main rod includes a durable rod of a diameter enabling insertion into the existing rod receiving indentations of the existing brackets. The spacer rod includes an identical diameter and material to the main rod and the sleeves include a hollow cylindrical portion. In use, a user places the rods end-to-end with one in each existing indentation and slides the end sleeves to engage each bracket while providing support between the rod portions.

7 Claims, 5 Drawing Sheets

(56) References Cited

U.S. PATENT DOCUMENTS

| | | | | |
|---|---|---|---|---|
| 5,826,847 | A * | 10/1998 | Warner et al. | 248/354.1 |
| 5,894,610 | A * | 4/1999 | Winter | 4/558 |
| 6,371,423 | B1 | 4/2002 | Miller | |
| 6,543,629 | B1 * | 4/2003 | Samelson | 211/105.1 |
| 7,287,734 | B2 * | 10/2007 | Bell | 248/262 |
| 7,520,492 | B1 * | 4/2009 | Lai | 256/65.05 |
| 7,628,363 | B2 * | 12/2009 | Goldstein | 248/261 |
| 7,926,772 | B2 * | 4/2011 | Lowe et al. | 248/222.14 |
| 8,214,938 | B2 * | 7/2012 | Hanley et al. | 4/610 |
| 2009/0223917 | A1 * | 9/2009 | Grant et al. | 211/105.4 |
| 2009/0242713 | A1 * | 10/2009 | Lowe et al. | 248/222.13 |

* cited by examiner

REPLACEMENT ROD KIT

RELATED APPLICATIONS

The present invention was first described in and claims the benefit of U.S. Provisional Application No. 61/308,834 filed on Feb. 26, 2010, the entire disclosures of which are incorporated herein by reference.

FIELD OF THE INVENTION

The present invention relates generally to towel support rods and fixtures, and in particular, to replacement rod which is capable of being coupled between a pair of rod hanging brackets.

BACKGROUND OF THE INVENTION

Towel rod racks are commonly seen in bathroom environments to hold towels, washcloths, hand towels, and the like. A wide variety of these towel racks utilize fixed end anchors to hold the towel rod in place. Quite often these end anchor brackets are of a decorative nature and may be even formed as part of the wall system especially when used with ceramic tiles. Unfortunately, such towel rods are prone to breakage over time. Repair of such towel rods usually means the removal of at least one end bracket in order to fit a new towel rod in place. Thus, a simple break often becomes a complicated repair, requiring knowledge, tools, and skills to perform tile work, grouting, and the like. The same is true if one wishes to redecorate or make changes to the look of a bathroom. In order to change the shape or style of the towel rod, the entire fixture must be removed and the remounted to the wall surface.

Attempts have been made to address these problems. Examples of such attempts can be seen by reference in U.S. Pat. No. 3,738,498 issued to Handley, which discloses a replaceable towel rod and U.S. Pat. No. 6,371,423 issued to Miller, which discloses a tubular rod and post assembly. While these attempts may achieve their purported objective each suffers from one or more disadvantage or deficiency related to design or utilization regarding the problems described.

SUMMARY OF THE INVENTION

The inventor has therefore recognized the aforementioned inherent problems and lack in the art and observed that there is a need for a device and method of use which provides for easy and quick replacement and repair of worn or broken towel rod racks without the disadvantages described. In accordance with the invention, it is an object of the present disclosure to solve these problems.

The inventor recognized these problems and has addressed this need by developing a replacement rod which allows for the replacement and repair of broken towel rods capable of being coupled between a pair of existing hanging rod brackets. The inventor has thus realized the advantages and benefits of providing a an elongated main rod having a first end insertingly coupled within an opening of a first hanging rod bracket and an opposing second end positioned adjacent to an opening of a second hanging rod bracket. A spacer rod is also provided having a first end insertingly coupled within the second hanging rod bracket opening and a second end protruding outwardly from the second rod bracket for occupying an open space between the main rod second end and the second hanging rod bracket. A first sleeve is also provided which is slidingly mounted over the main rod first end adjacent to the first hanging rod bracket opening. A second sleeve is provided which is slidingly mounted over the main rod second end and the spacer rod second end to couple the main rod and the spacer rod together.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
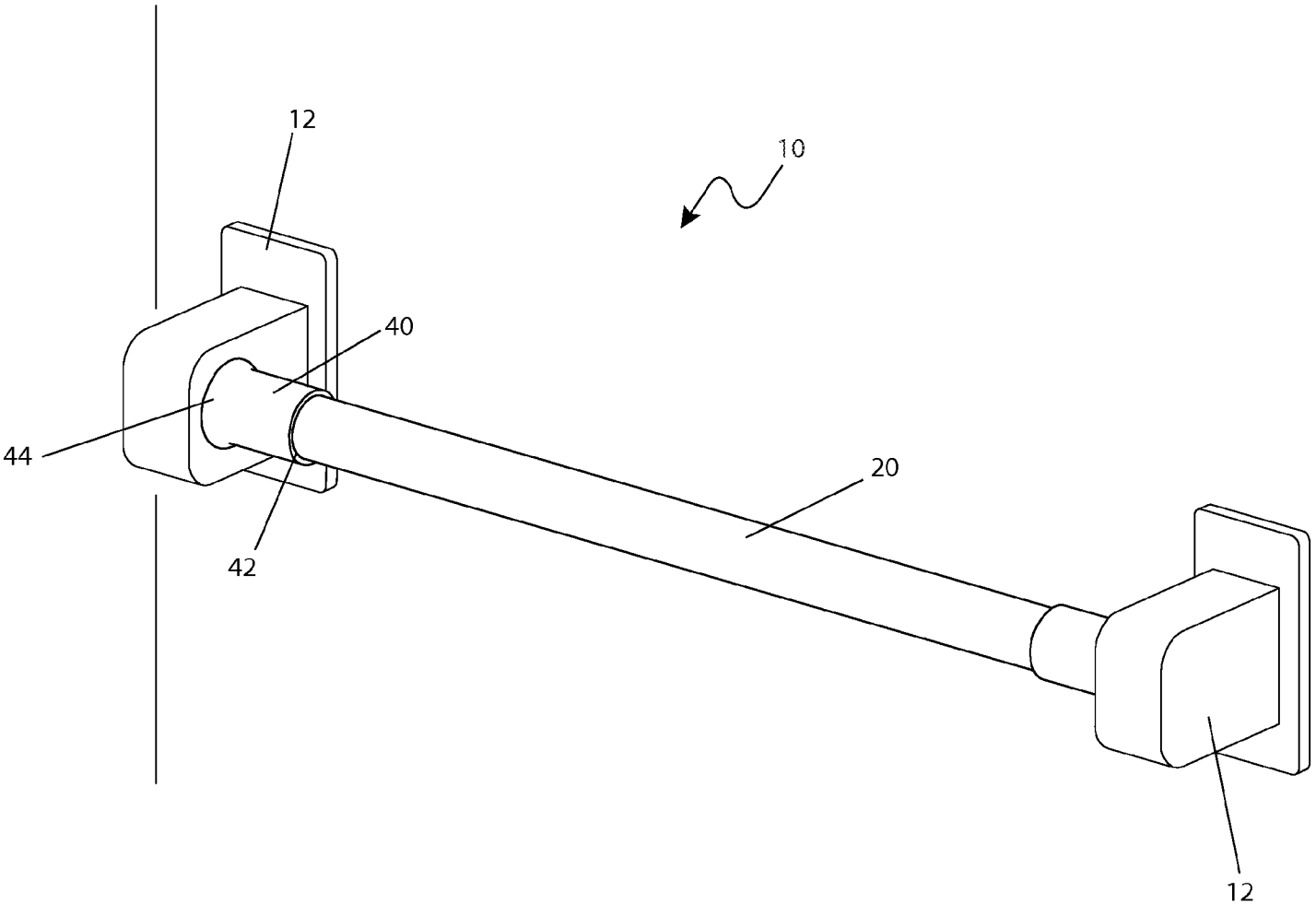
FIG. 1 is an environmental view of a replacement rod 10, according to a preferred embodiment in accordance with the invention.

10 replacement rod
12 bracket
20 main rod
30 spacer rod
40 sleeve
42 sleeve opening
44 flared portion

DETAILED DESCRIPTION OF THE PREFERRED EMBODIMENT

In accordance with the invention, the best mode is presented in terms of a preferred embodiment, herein depicted within FIGS. 1 through 7. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

In accordance with the invention, the present disclosure describes a replacement rod (herein described as a "device") 10, which provides a replacement kit for a broken towel rod. The device 10 is intended to replace broken towel racks such as, but not limited to; bathroom towel racks, clothing racks, or the like that are typically coupled to fixed end brackets 12 which are adhered or fastened to a vertical wall surface.

Figure 2:
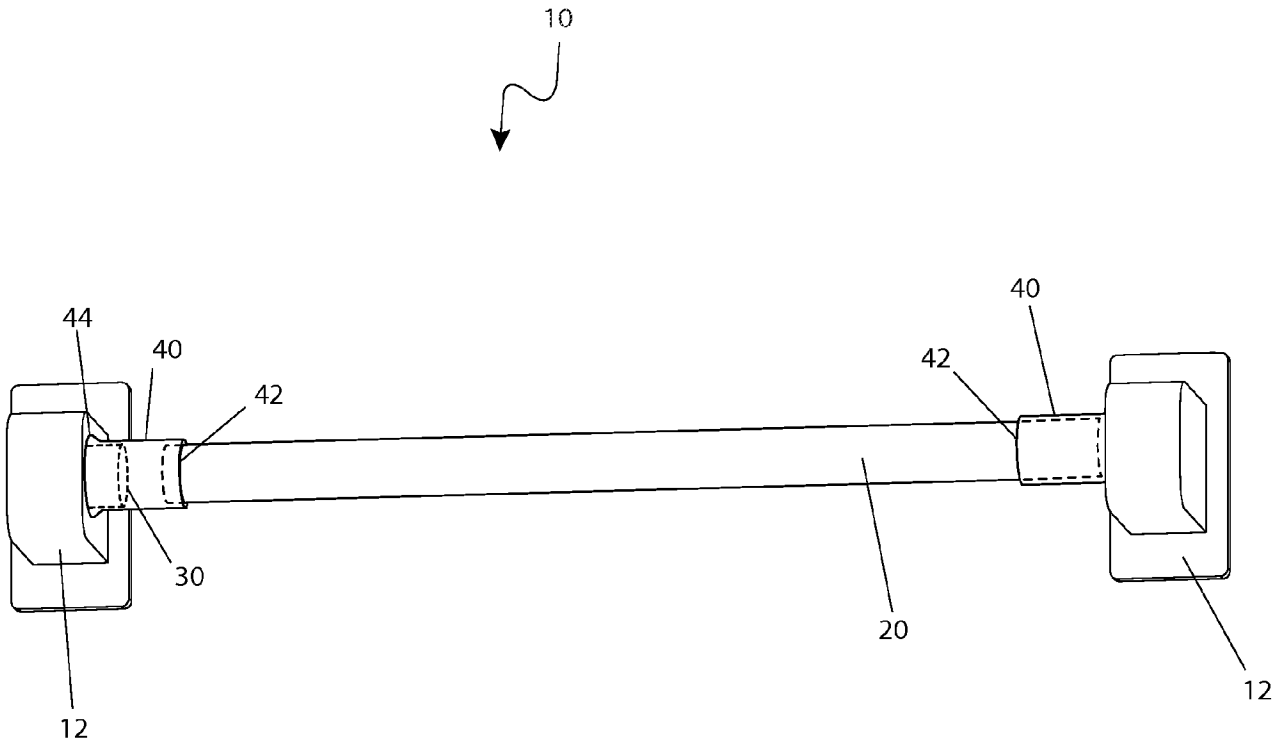
FIG. 2 is a perspective view of the replacement rod 10 in an assembled state, according to the preferred embodiment.
Figure 3:
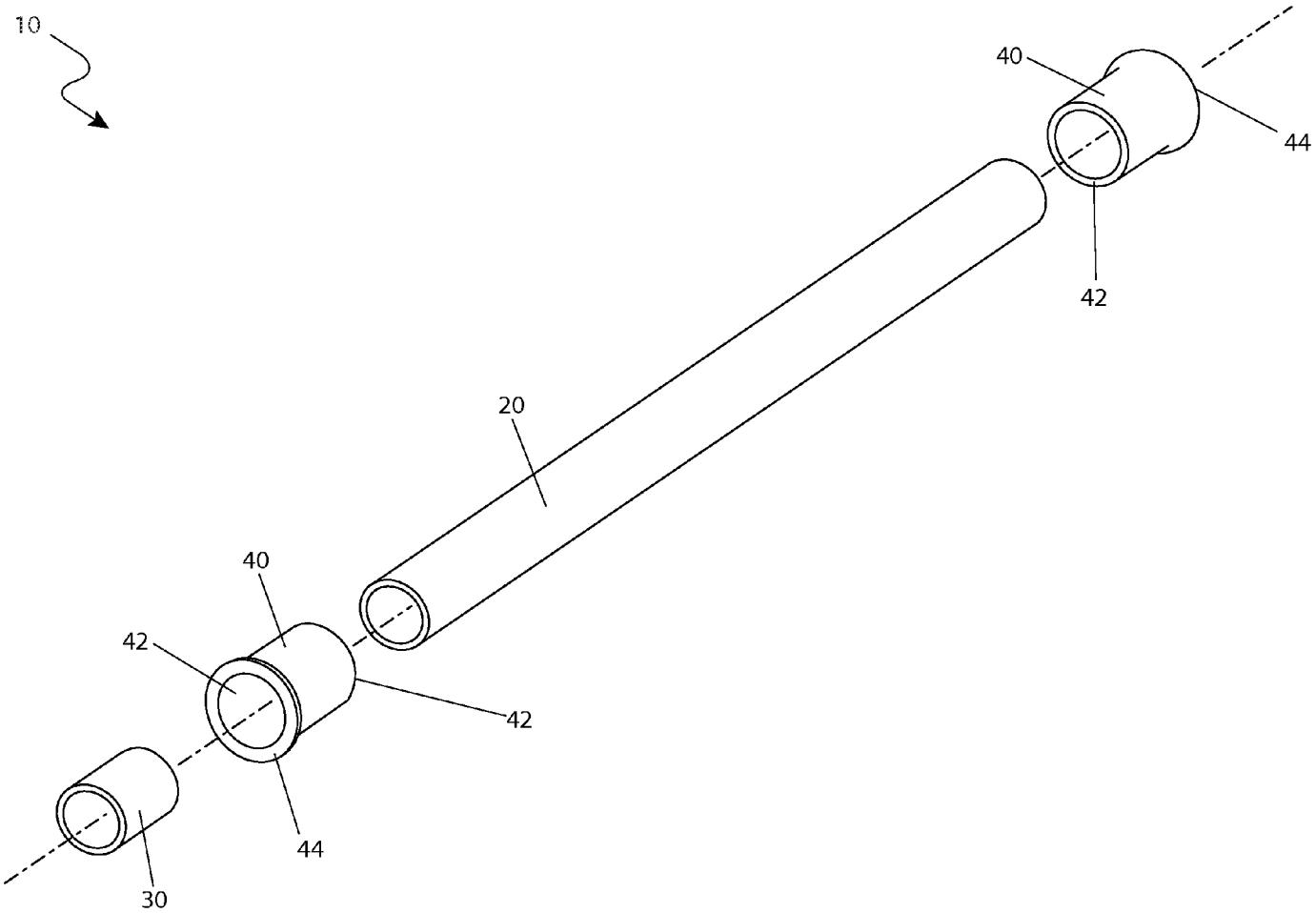
FIG. 3 is an exploded perspective view of the replacement rod 10, according to the preferred embodiment.

Referring now to FIG. 1, an environmental view of the device 10; FIG. 2, a perspective view of the device 10 in an assembled state; and, FIG. 3, an exploded view of the device 10 are disclosed. The device 10 utilizes existing end brackets 12 to suspend the device 10 which eliminates extensive demolition, rework, or repair to replace the entire towel rack. The brackets 12 include openings that receive ends of the device 10, such that it fits between each of the opposing brackets 12. The device 10 preferably includes a main rod 20, a spacer rod 30, and a pair of sleeves 40. The spacer rod 30 is inserted into each bracket 12 and is preferably retained by a friction fit, yet adhesives or fasteners may be utilized to permanently retain the spacer rod 30 within the bracket 12 without limiting the scope of the device 10. The device 10 is fabricated from materials such as, but not limited to; plastic, wood, metal, or the like and is preferably manufactured to be cut with a cutting tool to a desired length, yet may also be manufactured in various lengths and diameters to accommodate the particular existing end brackets 12.

Figure 4:
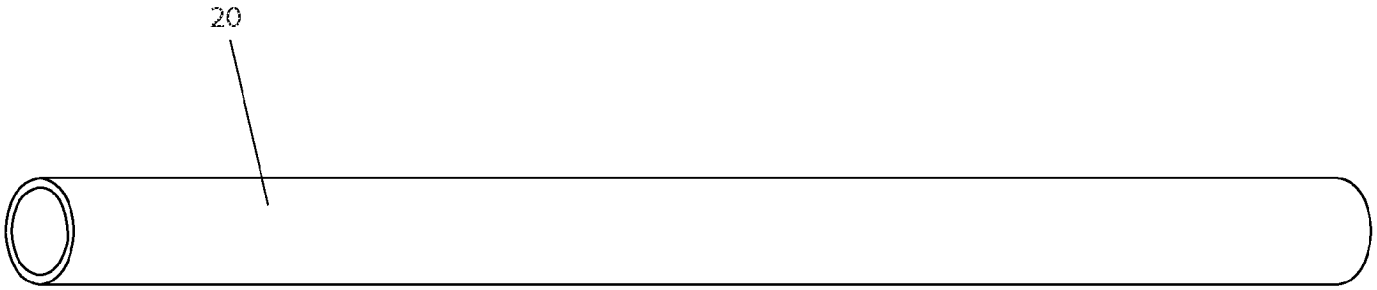
FIG. 4 is a perspective view of a main rod 20, according to the preferred embodiment.
Figure 5:
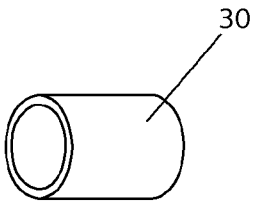
FIG. 5 is a perspective view of a spacer rod 30, according to the preferred embodiment.

Referring now to FIG. 4, a perspective view of the main rod 20 and FIG. 5, a perspective view of the spacer rod 30 are disclosed. The main rod 20 is an elongated cylindrical shaft that is horizontally oriented between the brackets 12 to provide a surface to drape or suspend towels, clothes, or the like. The main rod 20 preferably has a tubular shape to reduce weight of the device 10. The main rod 20 has a length slightly smaller that the distance between the pair of opposing end brackets 12. An exterior diameter of the main rod 20 is slightly smaller than an interior diameter of the sleeve 40 to allow the end of the rod 20 to be inserted into the sleeve 40 during installation of the device 10.

The spacer rod 30 preferably has a tubular shape with a diameter similar to that of the main rod 20 capable of being inserted into an end of the sleeve 40 opposite the main rod 20. An opposing end of the spacer rod 30 also has an exterior diameter slightly smaller than the opening in the each end bracket 12 for insertion and placement within the opposing brackets 12. The spacer rod 30 fills in the space between one bracket 12 and an end of the main rod 20 adjacent to that bracket 12. A combined length of the main rod 20 and spacer rod 30 is equivalent to the distance between the brackets 12 plus the depth of each the brackets 12 openings. At least one (1) end of each spacer rod 30 has an exterior profile which can fit within the opening of the end bracket 12.

Although the main rod 20 is depicted having a hollow interior and a generally cylindrical shape it can be appreciated that it can be of a solid body and have various external shapes without limiting the scope of the device 10. Although the spacer rod 30 is depicted having a hollow interior is can be appreciated that it can also have a solid body.

Figure 7:
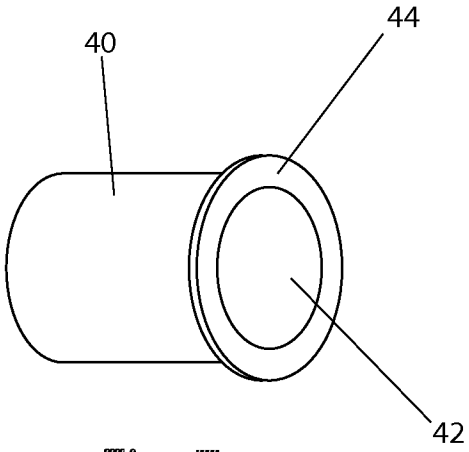
Figure 6:
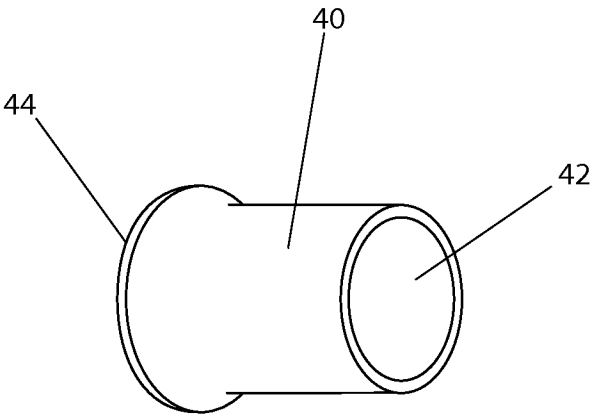
FIG. 6 is a perspective view of a sleeve 40, according to the preferred embodiment; and, FIG. 7 is an opposing perspective view of the sleeve 40, according to the preferred embodiment.

Referring now to FIG. 6, a perspective view of the sleeve 40 and FIG. 7, an opposing perspective view of the sleeve 40 are disclosed. The pair of sleeves 40 is utilized to couple the main rod 20 and the pair of spacer rods 30 together by a friction fit. Each sleeve 40 receives an end of the main rod 20 and an end of the spacer rod 30. Each sleeve 40 includes a sleeve opening 42 at each end and a flared portion 44 on one end. The sleeve openings 42 have an interior diameter slightly larger than the exterior diameter of the main rod 20 and the spacer rod 30 and a matching interior shape to allow the sleeves 40 to receive the ends of the main rod 20 and the spacer rod 30. Each sleeve 40 slides over the main rod 20 with the flared portion 44 toward the respective bracket 12. During installation, an end of the spacer rod 30 is inserted within the opening of the bracket 12 having an opposing end partially protruding outwardly from the bracket 12. Opposing ends of the main rod 20 are fully inserted into the pair of sleeves 40. The combined main rod 20 and pair of sleeves 40 is positioned between and aligned with the spacer rod 30 and the opposing bracket 12. One (1) end of the main rod 20 is inserted into the opening of the opposing end bracket 12 and the adjacent sleeve 40 is slid until the flared portion 44 is in contact with the bracket 12. The opposing sleeve 40 is slid toward the corresponding spacer rod 30 until the partially protruding end of the spacer rod 30 is inserted into the sleeve 40. The sleeve 40 is also positioned with the flared portion 44 in contact with a side of the bracket 12 having the spacer rod 30 inserted. The fully coupled combination of the main rod 20 with the sleeves 40 and the spacer rod 30 provide a decorative fixture which creates a uniform appearance to the assembled device 10. The flared portion 44 conceals a rectangular opening that may be found on various brackets 12.

It is envisioned that other styles and configurations of the present invention can be easily incorporated into the teachings of the present invention, and only one particular configuration shall be shown and described for purposes of clarity and disclosure and not by way of limitation of scope.

In accordance with the invention, the preferred embodiment can be utilized by the user in a simple and effortless manner with little or no training. After initial purchase or acquisition of the device 10, it would be installed as indicated in FIG. 1.

The method of installing and utilizing the device 10 may be achieved by performing the following steps: acquiring the device 10; removing the existing broken rod; inserting the spacer rod 30 into the towel rack opening of one bracket 12; positioning one (1) of the pair of sleeves 40 over the main rod 20 with the flared portion 44 toward the respective bracket 12; sliding the sleeve 40 which corresponds to the bracket 12 without the inserted spacer rod 30 inward to expose an end of the main rod 20; positioning the other sleeve 40 over the main rod 20 with the flared portion 44 toward the bracket 12 with the inserted spacer rod 30; positioning the main rod 20 between and aligned with the spacer rod 30 and the opposing bracket opening; inserting the exposed end of the main rod 20 into the opposing bracket opening; sliding the sleeve 40 which corresponds to the bracket 12 without the inserted spacer rod 30 outward until the flared portion 44 is in contact with the bracket 12; sliding the opposing sleeve 40 toward the opposing bracket 12 and receiving the spacer rod 30 to couple the main rod 20 to the spacer rod 30; sliding the sleeve 40 which corresponds to the bracket 12 with the inserted spacer rod 30 outward until the flared portion 44 is in contact with the bracket 12; suspending towels, clothes, or the like from the device 10; and, allowing for the quick repair of broken towel rods in a manner which is quick, easy, and effective.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A replacement rod device capable of being coupled between a first hanging rod bracket and a horizontally opposed second hanging rod bracket, said first and second hanging rod brackets each comprising an opening, said device comprising:

a rod assembly interconnected between said first and second hanging rod brackets, said rod assembly comprising:

an elongated main rod extending partially between said first hanging rod bracket and said second hanging rod bracket, said main rod comprising an exterior diameter, a first end configured to be removably received within said opening of said first hanging rod bracket, and an opposing second end spaced a distance away from said opening of said second hanging rod bracket, said distance between said main rod second end and said second hanging rod bracket defining an open space; and a spacer rod extending partially between said second hanging rod bracket and said second end of said main rod, said spacer rod comprising an exterior diameter-substantially equal to said exterior diameter of said main rod, a first end configured to be removably received within said opening of said second hanging rod bracket and a second end protruding outwardly from said second rod bracket, said second end occupying a portion of said open space between said main rod second end and said second hanging rod bracket;

a first sleeve freely moveable along and completely removable from said main rod, said first sleeve comprising a first end, an opposed second end, and an interior diameter, said interior diameter of said first sleeve being slightly larger than said exterior diameter of said main rod, and said first end of said first sleeve being configured to removably receive said first end of said main rod, wherein said first sleeve is slideably positioned over said first end of said main rod and directly adjacent to said opening of said first hanging rod bracket; and, a second sleeve freely moveable along and completely removable from said main rod and said spacer rod when said spacer rod is connected to said second hanging rod bracket, said second sleeve comprising a first end, an opposed second end, and an interior diameter-slightly larger than said exterior diameter of said main rod and said spacer rod, said first end of said second sleeve being configured to removably receive said second end of said main rod, and said second end of said second sleeve being configured to removably receive said second end of said spacer rod, wherein said second sleeve is slideably positioned over said second end of said main rod, said second end of said spacer rod, and an open space between said second end of said main rod and said second end of said spacer rod to couple said main rod and said spacer rod together and directly adjacent to said opening of said second hanging rod bracket.

2. The device of claim 1, wherein said first sleeve second end and said second sleeve second end each further comprises an outwardly extending flared portion;

wherein said flared portion of said first sleeve second end conceals said opening of said first hanging rod bracket when said first sleeve is slidingly positioned in contact with said first hanging rod bracket; and, wherein said flared portion of said second sleeve second end covers said opening of said second hanging rod bracket when said second sleeve is slidingly positioned in contact with said second hanging rod bracket.

3. The device of claim 2, wherein said main rod, said spacer rod, and said first and second sleeves each further comprise a circular cross section.

4. A replacement rod device comprising:

a first hanging rod bracket affixed to a vertical support surface, said first hanging rod bracket further comprising an opening at least partially through an inner sidewall;

a second hanging rod bracket affixed to said vertical support surface horizontally aligned with and spaced apart from said first hanging rod bracket, said second hanging rod bracket further comprising an opening at least partially through an inner sidewall, wherein said opening in said second hanging rod bracket faces said opening in said first hanging rod bracket;

a rod assembly interconnected between said first and second hanging rod brackets, said rod assembly comprising:

an elongated main rod extending partially between said first hanging rod bracket and said second hanging rod bracket, said main rod comprising an exterior diameter, a first end configured to be removably received within said opening in said first hanging rod bracket and an opposing second end spaced a distance away from said opening in said second hanging rod bracket, said distance between said main rod second end and said second hanging rod bracket defining an open space; and a spacer rod extending partially between said second hanging rod bracket and said second end of said main rod, said spacer rod comprising an exterior diameter-substantially equal to said exterior diameter of said main rod, a first end configured to be removably received within said opening in said second hanging rod bracket and a second end protruding outwardly from said second rod bracket for occupying a portion of said open space between said main rod second end and said second hanging rod bracket;

a first sleeve freely moveable along and completely removable from said main rod, said first sleeve comprising a first end, an opposed second end, and an interior diameter, said interior diameter of said first sleeve being slightly larger than said exterior diameter of said main rod, and said first end of said first sleeve being configured to removably receive said first end of said main rod, wherein said first sleeve is slideably positioned over said first end of said main rod and directly adjacent to said opening in said first hanging rod bracket; and, a second sleeve freely moveable along and completely removable from said main rod and said spacer rod when said spacer rod is connected to said second hanging rod bracket, said second sleeve comprising a first end, an opposed second end, and an interior diameter-being slightly larger than said exterior diameter of said main rod and said spacer rod, said first end of said second sleeve being configured to removably receive said second end of said main rod, and said second end of said second sleeve being configured to removably receive said second end of said spacer rod, wherein said second sleeve is slideably positioned over said second end of said main rod, said second end of said spacer rod and an open space between said second end of said main rod and said second end of said spacer rod to couple said main rod and said spacer rod together and directly adjacent to said opening in said second hanging rod bracket.

5. The device of claim 4, wherein said first sleeve second end and said second sleeve second end each further comprises an outwardly extending flared portion;

wherein said flared portion of said first sleeve second end conceals said opening in said first hanging rod bracket when said first sleeve is slidingly positioned in contact with said first hanging rod bracket; and, wherein said flared portion of said second sleeve second end covers said opening in said second hanging rod bracket when said second sleeve is slidingly positioned in contact with said second hanging rod bracket.

6. The device of claim 5, wherein said first hanging rod bracket opening further comprises a peripheral dimension suitable to receive said main rod first end; and, wherein said second hanging rod bracket opening further comprises a peripheral dimension suitable to receive said spacer rod first end.

7. The device of claim 6, wherein said main rod, said spacer rod, and said first and second sleeves each further comprise a circular cross section.

* * * * *